US006805020B2

(12) United States Patent
Onodera

(10) Patent No.: US 6,805,020 B2
(45) Date of Patent: Oct. 19, 2004

(54) MANUAL INPUT DEVICE ENABLING CONTROL OF VARIOUS ELECTRIC APPARATUS WITH SINGLE KNOB

(75) Inventor: Mikio Onodera, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 87 days.

(21) Appl. No.: 10/123,362

(22) Filed: Apr. 15, 2002

(65) Prior Publication Data

US 2002/0148317 A1 Oct. 17, 2002

(30) Foreign Application Priority Data

Apr. 16, 2001 (JP) ..... 2001-117080

(51) Int. Cl.[7] ..... H01H 25/04; G05G 9/00

(52) U.S. Cl. ..... 74/471 XY; 74/469; 345/161

(58) Field of Search ..... 74/471 XY, 469, 74/471 R, 479.01, 480 R, 490.02, 491; 338/128; 345/161

(56) References Cited

U.S. PATENT DOCUMENTS 3,788,649 A * 1/1974 Hirano ..... 381/19
3,795,882 A * 3/1974 Tokubo ..... 338/128
3,918,021 A * 11/1975 Nishioka et al. ..... 338/128
4,459,578 A * 7/1984 Sava et al. ..... 338/128
4,784,008 A * 11/1988 Paquereau et al. ..... 74/471 XY
4,849,583 A * 7/1989 Meyer ..... 200/6 A
4,926,172 A * 5/1990 Gorsek ..... 341/20
5,841,372 A 11/1998 Matsumoto ..... 341/20
5,959,863 A * 9/1999 Hoyt et al. ..... 700/85
5,995,104 A 11/1999 Kataoka et al. ..... 345/355

FOREIGN PATENT DOCUMENTS

EP 0 877 312 11/1998
EP 0 960784 A1 12/1999

* cited by examiner

*Primary Examiner*—David A. Bucci
*Assistant Examiner*—Julie K. Smith
(74) *Attorney, Agent, or Firm*—Brinks Hofer Gilson & Lione

(57) ABSTRACT

A manual input device which comprises a mechanism, a major function select switch, a confirm switch, a display unit, and a controller. The mechanism is composed of: a laterally movable motor for applying an external force which is mounted on a frame; a knob fitted to a drive shaft of the motor; an encoder for detecting rotation of the knob; a stick controller for detecting lateral movement of the motor; a first guide plate and a second guide plate for limiting a range of movement of the knob; and a first solenoid and a second solenoid for driving the guide plates individually. The guide groove pattern is different between the first and second guide plates. The range in which the knob can be moved when the first guide plate only is engaged with the drive shaft of the motor is different from that when both the first and second guide plates are engaged with the drive shaft of the motor.

14 Claims, 10 Drawing Sheets

MANUAL INPUT DEVICE ENABLING CONTROL OF VARIOUS ELECTRIC APPARATUS WITH SINGLE KNOB

BACKGROUND OF THE INVENTION

1. Field of the Invention

The present invention relates to a manual input device which enables central control with a single knob of various electric apparatuses which are, for example, mounted in a car, and particularly to means for selecting the direction of manipulation of the above-mentioned knob.

2. Description of Related Art

Modern cars are equipped with various electric apparatuses such as an air conditioner, radio, television, CD player and navigation system. If the driver tries to operate many such electric apparatuses individually using the respective control means provided on these apparatuses during a drive, he/she may be unable to drive the car smoothly. In order to allow the driver to turn on or off any desired electric apparatus, select a function or perform any other operation without any inconvenience for his/her safe drive, a manual input device which enables the driver to control various electric apparatuses by manipulation of a single knob has been proposed.

This kind of manual input device as prior art will be explained referring to FIGS. 13 to 16. FIG. 13 shows an example of a manual input device installed in a car; FIG. 14 is a side view illustrating a proposed conventional manual input device; FIG. 15 is a top view illustrating the knob of the manual input device as shown in FIG. 14; and FIG. 16 is a top view illustrating the guide plate built in the manual input device as shown in FIG. 14.

As illustrated in FIG. 13, this manual input device 100 is installed in a console box 200 located between the driver's seat and the passenger's seat. As shown in FIG. 14, this conventional manual input device 100 is mainly composed of the following: a knob 110 which has two clicking switches 111 and 112 as signal input means and three rotary variable resistors 113, 114 and 115 (see FIG. 15); an XY table 120 which is driven in two directions perpendicular to each other (a direction perpendicular to the side view in FIG. 14 and the right-left direction as you face the figure) by the knob 110; a stick controller 130 as a position sensor which inputs a signal to an external apparatus according to the direction and amount of movement of the XY table 120; and a guide plate 140 which engages with an engagement pin 160 projecting downward from the bottom face of the XY table 120 (see FIG. 16).

The knob 110 and XY table 120 are connected through a connecting shaft 150 and the XY table 120 and guide plate 140 are engaged with each other by the engagement pin 160 whose tip is movably inserted in a guide groove 141 of the guide plate 140. This guide groove 141 may have any shape which allows the tip of the engagement pin 160 to be moved in specific directions. For instance, as shown in FIG. 16, when a guide groove 141 in the plane shape of a cross is engraved on the upper surface of the guide plate 140, the tip of the engagement pin 160 can be moved from the center A to end points B, C, D and E as shown, in the two directions which intersect almost perpendicularly. In other words, by manipulating the knob 110, the engagement pin 160 can be moved along the guide groove 141 of the guide plate 140 through the XY table 120 so that, with the tip of the engagement pin 160 at end point A, B, C, D or E in the guide groove 141, the information on that engagement position (positional signal) is outputted from the stick controller 130. This means that it is possible to select a car-mounted electric apparatus function to be operated (a function to be controlled). Once the desired electric apparatus function is selected in this way, the selected function can be adjusted or switched on or off by manipulating the two clicking switches 111 and 112 on the knob 110 and the three rotary variable resistors 113, 114 and 115 as appropriate.

As shown in FIG. 13, the manual input device 100 thus structured allows central control of a plurality of car-mounted electric apparatuses by the use of a combination of a switch device 170 and a display unit 180 and a computer as a controller (not shown in the figure). Here, the switch device 170 enables the user to select a desired electric apparatus among the ones mounted in the car; the display unit 180 indicates various information including the name of the electric apparatus selected through the switch device 170 and information on the operation done by means of the manual input device 100; and the computer controls these. The switch device 170 is installed in the console box 200 and its control switches 171*a* to 171*e* are located in the vicinity of the manual input device 100 and connected with different electric apparatuses. If the control switches 171*a* to 171*e* are respectively connected to a car-mounted air conditioner, radio, television, CD player and navigation system, the user can turn on or off the air conditioner or specify the air conditioner mode to the manual input device 100 using the control switch 171*a*, or turn on or off the radio or specify the radio mode to the manual input device 100 using the control switch 171*b*; likewise, by operating the other control switches 171*c* to 171*e*, the user can turn on or off the corresponding electric apparatuses or specify their modes to the manual input device 100. The display unit 180 (for example, a liquid crystal display) is conveniently located for the driver's viewing and the computer is built in the console box 200.

While it is possible to select a function of the electric apparatus selected through the switch device 170 or make a functional adjustment using the manual input device 100, the functions which can be selected or adjusted through the manual input device 100 vary depending on the type of electric apparatus selected. For example, if the air conditioner mode is selected using the switch device 170, the function of "air flow rate control" is selected by manipulating the knob 110 to bring the engagement pin 160 to the end point B of the guide groove 141 of the guide plate 140 and pushing in the clicking switch 111 with a click; likewise the function of "air blow-off position control," the function of "air blow-off direction control" and the function of "temperature control" are selected by manipulating the knob 110 to bring the pin 160 to the end points C, D, and E of the guide groove 141, respectively, to click the clicking switch 111.

Once one of these control functions has been selected, the selected function can be adjusted by manipulating the rotary variable resistors 113 to 115 as appropriate. For example, if the air conditioner mode is selected by means of the switch device 170 and the function of "air flow rate control" is selected by means of the clicking switch 111, the air conditioner's air flow rate can be controlled by manipulating the rotary variable resistor 113; likewise, if the function of "air blow-off position control" is selected, the air conditioner's air blow-off position can be controlled by manipulating the rotary variable resistors 114 and 115. Further, if the radio mode is selected by means of the switch device 170 and the function of "volume control" is selected by means of the clicking switch 111, the radio's volume can be controlled by manipulating the rotary variable resistor 113; likewise if the "tuning" function is selected in the radio mode, tuning of the radio can be done by manipulating the rotary variable resistors 114 and 115.

However, in the conventional manual input device 100, because the knob 110 is held connected with the guide plate 140 through the XY table 120, and the knob 110 can be manipulated only in specific directions which are determined by the engagement of the tip of the engagement pin 160 with the guide groove 141 of the guide plate 140, the knob 110 can be used only for selecting a function of the electric apparatus selected by the switch device 170 and it is difficult to use the knob 110 for various purposes. For example, it cannot be to used to select both an electric apparatus and a function of the selected apparatus, or to select an electric apparatus function and control the selected function, or to select an electric apparatus, select a function of the selected apparatus and control the selected apparatus function. Therefore, it is not easy to make the knob 110 more versatile and improve the operability of the manual input device 100.

Let's assume as follows: eight electric apparatuses (air conditioner, radio, DVD player, CD player, telephone, speech input system, car navigation system and 2nd) are selectable; four radio functions (AM, FM and shortwave station selection and volume) are adjustable; and the radio volume can be controlled in two ways, namely by either increasing or decreasing the volume. In this case, if the knob 110 of the manual input device 100 is used to select the radio and the volume control function and perform a volume control in sequence, the knob 110 should be movable in eight directions for selection of the radio, in four directions for selection of the radio volume control function, and in two directions for volume control.

However, in the conventional manual input device 100, as stated above, the knob 110 can be moved only in specific directions which are determined by the engagement of the tip of the engagement pin 160 with the guide groove 141 of the guide plate 140, so the number of directions in which the knob 110 can be moved cannot be varied depending on the type of function to be selected or controlled with the knob 110. Accordingly, there would be dead zones in which no functional selection or control is not performed even by manipulating the knob 110. Specifically, in order to allow selection of the radio from among the eight electric apparatuses by manipulation of the knob 110, there should be guide grooves 141 extending radially in eight directions from the center in the guide plate 140, but if such grooves are provided, in selecting the radio volume control function, four directions (grooves) except those for AM, FM and shortwave station selection and volume control would be dead zones; and in carrying out a radio volume control, six directions (grooves) except those for volume increase and decrease would be dead zones.

Furthermore, if the car navigation system is selected by manipulation of the knob 110, a means for moving the cursor which appears along with a map image on the display unit 180 would be necessary. However, as mentioned above, the knob 110 of the conventional manual input device 100 cannot be moved in a desired direction freely because it is held engaged with the guide plate 140; as a consequence, it cannot be used as a means for moving the cursor in the car navigation system. Therefore, in order to enable the car navigation system to be controlled with the manual input device 100, a cursor moving means other than the knob 110 would be needed. This implies that the manual input device 100 would have a complicated structure and be not easy to operate.

SUMMARY OF THE INVENTION

The present invention has been made in view of the above circumstances and provides a user-friendly manual input device with a simple structure.

According to one aspect of the present invention, as a solution to the above problem, a manual input device comprises: a knob which is movable in a desired direction and is moved in a specific direction from a center position to select a specific function among functions of a plurality of electric apparatuses and control the selected function; a plurality of guide plates which limit directions in which the knob can be moved; actuators which change engagement of the knob with the plural guide plates; and a controller for the actuators, wherein the controller controls operation of the actuators depending on the electric apparatus function selected by manipulation of the knob and selectively limits the directions in which the knob can be moved.

Accordingly, when the manual input device comprises a knob which can be moved in a desired direction, a plurality of guide plates which limit the directions in which the knob can be moved, actuators which change the engagement of the knob with a plurality of guide plates and a controller and the controller controls operation to change the engagement of the knob with the guide plates as appropriate, by disengaging the knob from the guide plates it can be moved in a desired direction, and by engaging it with at least one guide plate, the directions in which it can be moved are limited to the ones determined by a single guide plate or a combination of guide plates engaged with it. Thus, the range of movement of the knob can be changed in multiple steps. When different selectable or controllable functions are assigned to different directions of movement of the knob, dead zones can be eliminated and the knob can be used for multiple purposes. Accordingly, a user-friendly manual input device is provided.

According to another aspect of the present invention, as a solution to the above problem, the manual input device uses a first guide plate which limits movement of the knob to eight directions and a second guide plate which limits movement of the knob to four directions.

According to a further aspect of the present invention, as a solution to the above problem, the manual input device uses a first actuator which drives the first guide plate and a second actuator which drives the second guide plate.

According to another further aspect of the present invention, as a solution to the above problem, the first guide plate has eight guide grooves extending radially in eight directions every 45 degrees and the second guide plate has guide grooves extending in four directions every 90 degrees.

According to a further aspect of the present invention, as a solution to the above problem, four guide grooves among the eight guide grooves in the first guide plate coincide with the four guide grooves in the second guide plate when the first and second guide plates are joined.

According to a further aspect of the present invention, as a solution to the above problem, the manual input device has a display unit which displays a screen matched to directions in which the knob can be moved.

When, as mentioned above, two guide plates are provided as means for limiting the directions of movement of the knob, by engaging it only with the first guide plate, the directions of movement of the knob are limited to the first range determined by the first guide plate, and by engaging it with both the first and second guide plates, they are limited to the second range determined by the combination of the guide plates. Further, by disengaging the knob from the first and second guide plates, the knob can be moved in any direction. Therefore, when the first guide plate has eight guide grooves (directions) and the second guide plates has four guide grooves (directions) which coincide with four of the eight guide grooves, if eight types of electric apparatus are respectively assigned to the eight directions in which the knob can be moved by its engagement with the first guide plate only and four different functions are respectively assigned to the four directions in which it can be moved by its engagement with both the first and second guide plates, one among the assigned eight electric apparatuses can be easily selected in electric apparatus selection by engaging it with the first guide plate and one among the four assigned functions can be easily selected in functional selection by engaging it with both the first and second guide plates. When the car navigation system is selected, the knob can be used as a means for moving the cursor on a map screen by disengaging it from the first and second guide plates. In addition, when a mark which indicates the direction of movement of the knob appears on the screen of the display unit, operating ease is increased.

According to a further aspect of the present invention, as a solution to the above problem, the manual input device has a second actuator for applying an external force to the knob and the controller controls operation of the second actuator to apply an external force to the knob depending on how the knob has been manipulated.

When, as mentioned above, the manual input device has a second actuator for applying an external force to the knob and the controller controls operation of the second actuator to apply an external force to the knob depending on the manipulation of the knob, the user can know, with a tactile sensation or without seeing the screen, how the knob has been manipulated; in other words, the user can know with a tactile sensation whether the selection or control as intended has been done by his/her manipulation of the knob, which can prevent improper manipulation of the knob.

BRIEF DESCRIPTION OF THE DRAWINGS

The invention will be more particularly described with reference to the accompanying drawings, in which.

DETAILED DESCRIPTION OF THE PREFERRED EMBODIMENTS

Figure 1:
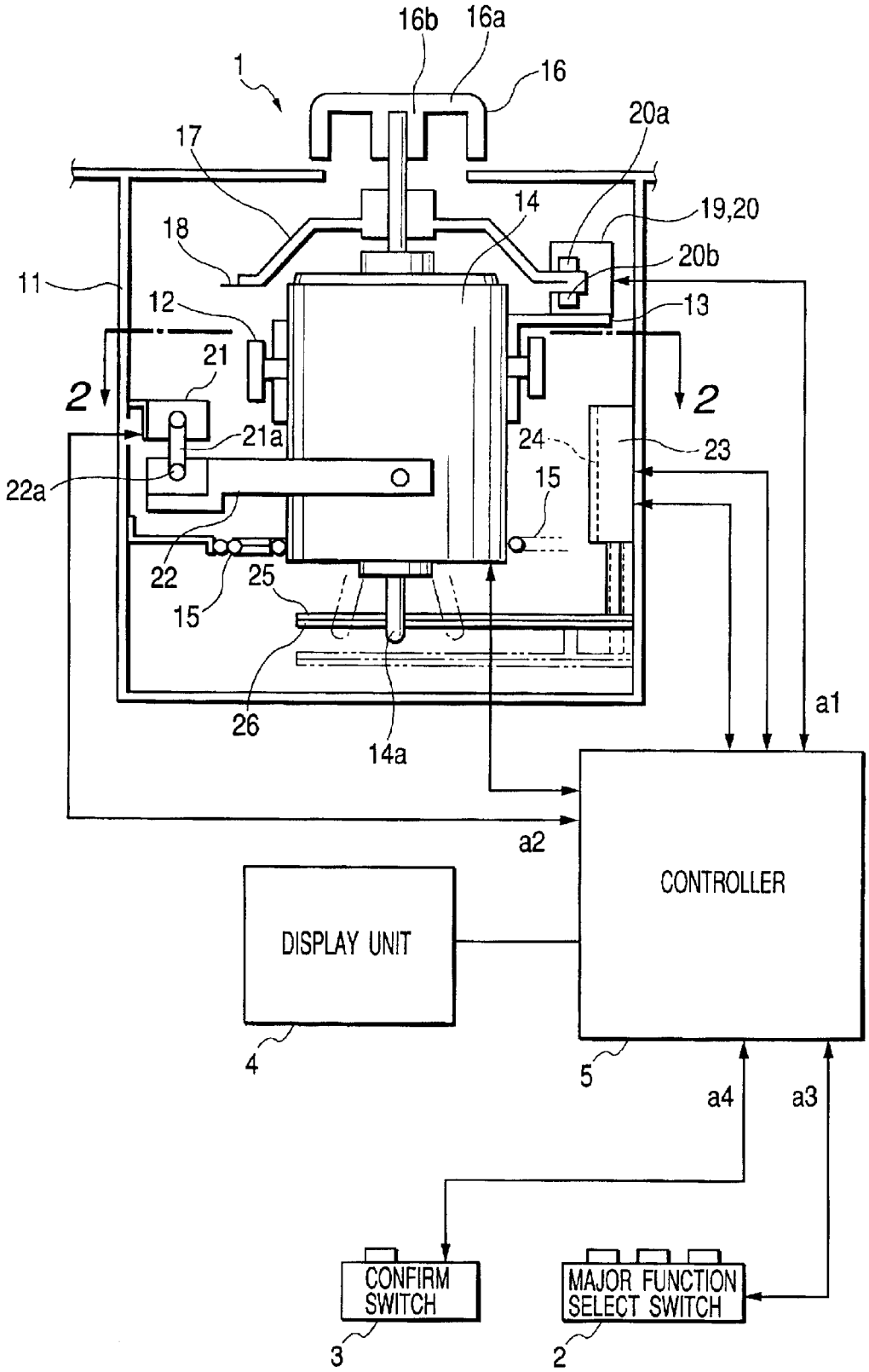
FIG. 1 shows the structure of a manual input device according to an embodiment of the present invention.
Figure 2:
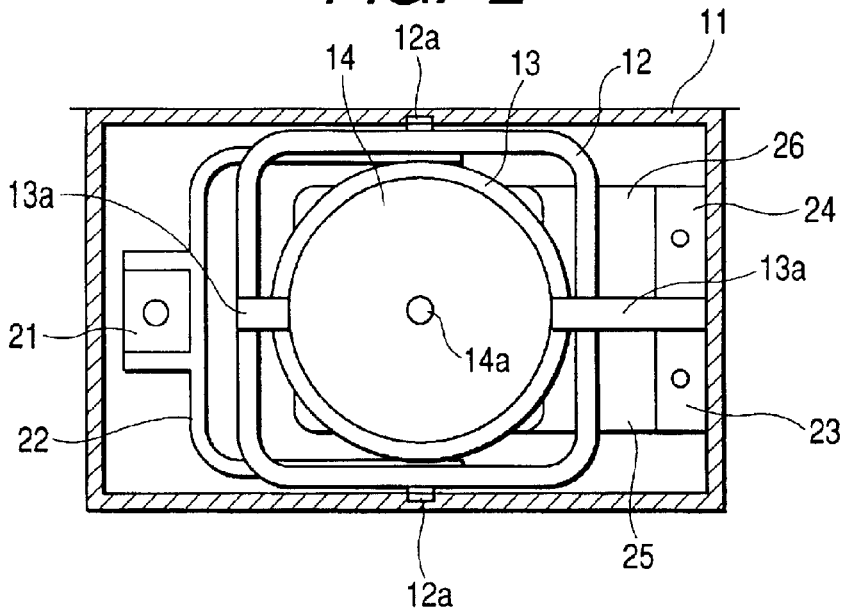
FIG. 2 is a sectional view taken along the line 2—2 of FIG. 1.
Figure 3A:
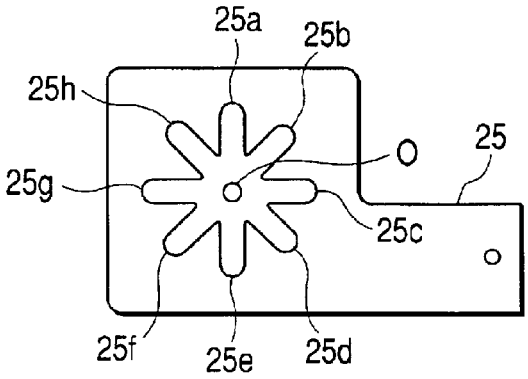
FIGS. 3A and 3B are top views showing singe guide plates in the manual input device and FIG. 3C is a top view showing a combination of such guide plates.
Figure 3B:
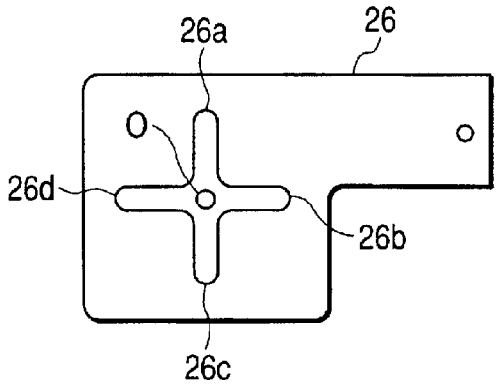
Figure 3C:
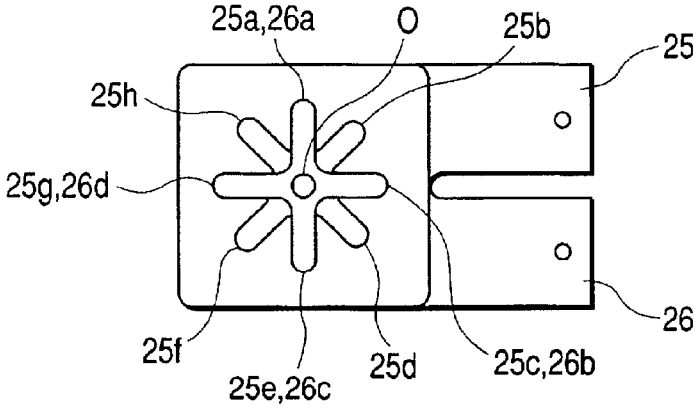

Next, the structure of a manual input device according to an embodiment of the present invention will be described referring to FIGS. 1 to 3. FIG. 1 shows the structure of a manual input device according to the embodiment; FIG. 2 is a sectional view taken along the line 2—2 of FIG. 1; and FIGS. 3A and 3B are top views showing singe guide plates in the manual input device and FIG. 3C is a top view showing a combination of such guide plates.

As is clearly seen from FIG. 1, the manual input device according to this embodiment mainly comprises a mechanism 1, a major function select switch 2, a confirm switch 3, a display unit 4 and a controller 5. The mechanism 1 is composed of the following: a cylindrical frame 11; a laterally movable swing bracket 12 which is fitted to the frame 11; a laterally movable motor bracket 13 which is fitted to the swing bracket 12; a motor 14 which is mounted on the motor bracket 13; a pressing member 15 which returns the laterally moved motor 14 to its center position; a knob 16 and a codewheel holder 17 which are fitted to the drive shaft 14*a* of the motor 14; an encoder 20 which consists of a codewheel 18 mounted on the codewheel holder 17 and a photointerrupter 19 mounted on the motor bracket 13; a stick controller 21 which detects lateral movement of the motor 14; an arm 22 one end of which is rotatably attached to the motor 14 and the other end of which drives a stick 21*a* in the stick controller 21; a first solenoid 23 and a second solenoid 24 provided on the inner surface of the frame 1; a first guide plate 25 which is driven by the first solenoid 23; and a second guide plate 26 which is driven by the second solenoid 24.

As illustrated in FIG. 2, the swing bracket 12 is a square ring in which the motor bracket 13 and the motor 14 can be inserted in a laterally movable manner; it has a support shaft 12*a* protruding outward from the center of each of two opposite sides. The swing bracket 12 is laterally movable with respect to the frame 11 because the support shaft 12*a* is held against the frame 11 in a laterally movable manner. On the other hand, the motor bracket 13 is a circular ring in which the motor 14 can be inserted; it has a support shaft 13*a* protruding outward from each of two opposite points on the circumference of the ring. The motor bracket 13 is laterally movable with respect to the swing bracket 12 because the support shaft 13*a* is held against the swing bracket 12 in a laterally movable manner. The positional relation of the support shaft 12*a* with respect to the frame 11 and that of the support shaft 13*a* with respect to the swing bracket 12 are determined so that the shafts are perpendicular to each other. The motor 14 is fastened to the motor bracket 13 using screws or other fastening means. Therefore, the drive shaft 14*a* of the motor 14 is laterally movable in any direction with respect to the frame 11 where the center of lateral movement is determined by the position of the support shaft 12*a* protruding from the swing bracket 12 and the position of the support shaft 13*a* protruding from the motor bracket 13.

The motor 14 gives the knob 16 an external force which depends on how the knob 16 is manipulated. It may be, for example, a rotary motor or linear motor.

The pressing member 15 which resets the knob to its center position is an elastic material such as a spring or a rubber strap which stretches between the frame 11 and the motor 14. The pressing member 15 adjusts the posture of the drive shaft 14*a* of the motor 14 so as to keep it in its upright position while the knob 16 is not being manipulated. While the knob 16 is being manipulated, the drive shaft 14*a* is laterally moved against the elastic force of the pressing member 15 in the same direction as the knob 16 is moved. As the manipulation force applied to the knob 16 is removed, the drive shaft 14*a* is automatically reset to its upright position due to the elastic force of the pressing member 15.

The knob 16 is designed to laterally move and rotate the drive shaft 14*a*. It consists of a cap-like body 16*a* of a size suitable for manipulation with fingers, and a virtually cylindrical coupling 16*b* extending vertically from the bottom of the center of the body 16*a*. The knob 16 is integrated with the motor 14 by forcedly engaging or snapping the drive shaft 14*a* of the motor 14 into the coupling 16*b*.

The codewheel holder 17 is a disc with a through hole 17*a* in the center. It is integrated with the motor 14 by forcedly engaging or snapping the drive shaft 14*a* of the motor 14 into the through hole 17*a*.

The encoder 20 consists of a codewheel 18 fitted to the codewheel holder 17 and a photointerrupter 19 provided on the motor bracket 13. The photointerrupter 19 consists of a light emitting element 20*a* and a light detecting element 20*b* facing each other with the codewheel 18 between them. The encoder 20 outputs positional signal a1 which depends on the conditions of rotation of the knob 16, namely the direction and amount of rotation of the drive shaft 14*a*.

The stick 21*a* of the stick controller 21 is connected through a ball bearing 22*a* with one end of the arm 22 the other end of which is rotatably fitted to the motor 14. As the motor 14 is laterally moved, the stick 21*a* is laterally moved by the amount proportional to the amount of lateral movement of the drive shaft 14*a*. The stick controller 21 outputs positional signal a2 which depends on the conditions of lateral movement of the knob 16, namely the direction and amount of lateral movement of the drive shaft 14*a*.

The first guide plate 25 is used as a means to control the direction of lateral movement of the knob 16 when selecting an electric apparatus. As shown in FIG. 3A, it has guide grooves 25*a*, 25*b*, 25*c*, 25*d*, 25*e*, 25*f*, 25*g* and 25*h* which radially extend in eight directions from the center position O every 45 degrees. The second guide plate 26 is used as a means to control the direction of lateral movement of the knob 16 when selecting a function. As shown in FIG. 3B, it has guide grooves 26*a*, 26*b*, 26*c*, and 26*d* which radially extend in four directions from the center position O every 90 degrees. The width of these guide grooves is designed to allow the drive shaft 14*a* to pass through them. As shown in FIG. 3C, the first and second guide plates 25, 26 are joined in a manner to ensure coincidence between the center positions O of both the plates and between guide grooves 25*a* and 26*a*, between guide grooves 25*c* and 26*b*, between guide grooves 25*e* and 26*c*, and between guide grooves 25*g* and 26*d* and to make the center position O of the plates align with the drive shaft 14*a* in its center position. The guide plates thus joined are mounted inside the frame 1 with the first guide plate 25 on the side of the motor 14.

The first guide plate 25 is driven up and down by the first solenoid 23 inside the frame 1 as shown in FIG. 1; it is set either to its upper position or to its lower position; when it is in its upper position, the drive shaft 14*a* of the motor 14 passes through the guide grooves 25*a* to 25*h*, and when it is in its lower position, the drive shaft 14*a* of the motor 14 is free from the guide grooves. The second guide plate 26 is driven up and down by the second solenoid 24 inside the frame 1 as shown in FIG. 1; it is set either to its upper position or to its lower position; when it is in its upper position, the drive shaft 14*a* of the motor 14 passes through the guide grooves 26*a* to 25*d*, and when it is in its lower position, the drive shaft 14*a* of the motor 14 is free from the guide grooves.

When the first guide plate 25 and the second guide plate 26 are both in their lower position, the drive shaft 14*a* is disengaged from the guide grooves 25*a* to 25*h* and 26*a* to 26*d*, so the knob 16 can be freely moved in any direction within the sphere having the center of lateral movement of the motor 14 as its center. When only the first guide plate 25 is set to its upper position by means of the first solenoid 23, the drive shaft 14*a* passes through the guide grooves 25*a* to 25*h* and the knob 16 can be moved only in the eight directions determined by the guide grooves 25*a* to 25*h*. When the first guide plate 25 and the second guide plate 26 are both in their upper position, the drive shaft 14*a* passes through the guide grooves 26*a* to 26*d* and the knob 16 can be moved only in the four directions determined by the guide grooves 26*a* to 26*d*.

In the manual input device according to this embodiment, when the user is going to select an electric apparatus, or when only the guide plate 25 is in its upper position, one of the eight registered electric apparatuses can be selected by laterally moving the knob 16 along the guide grooves 25*a* to 25*h*. The above eight electric apparatuses may be an air conditioner, radio, DVD player, CD player, telephone, speech input system, car navigation system and 2nd. Here, 2nd includes a monitor camera and electric equipment for e-mail. On the other hand, when the user is going to select a function, or when the first guide plate 25 and the second guide plate 26 are both in their upper position, one of the four registered functions can be selected by laterally moving the knob 16 along the guide grooves 26*a* to 26*d* formed in the second guide plate 26. For example, if the radio is selected in electric apparatus selection, it is possible to select one of the following options: "AM station selection," "FM station selection," "shortwave station selection" and "volume control." Therefore, the manual input device according to this embodiment has no dead zone regarding the direction of manipulation of the knob 16. In other words, a choice is made without fail by manipulating the knob 16. This improves operability. The selected function can be controlled by rotating the knob 16.

The major function select switch 2 is used to select one among the most basic functional systems to be selected or controlled by the use of the manual input device. For example, when the user uses the knob 16 to select and control (1) a comfort system such as the air conditioner, radio, DVD player, CD player, telephone, speech input system or car navigation system, (2) a mechanical drive system such as a steering wheel tilt device, steering telescope device or seat adjuster or (3) a car drive system such as an automatic driving device or constant speed driving device, the major function select switch 2 is used to select one among the three functional systems, i.e. "comfort system," "mechanical drive system" and "car drive system." This major function select switch 2 has a plurality of (three in the example of FIG. 1) switches 2*a*, 2*b* and 2*c* and selection signal a3 for selection of the "comfort system", "mechanical drive system" or "car drive system" is issued by operating the corresponding switch.

The confirm switch 3 finalizes the selection of an electric apparatus made by manipulation of the knob 16 and sets the controller 5 to the control mode appropriate to the selected electric apparatus. By operating the confirm switch 3, a final signal for selection a4 is issued. For better operability of the manual input device, this confirm switch 3 may also be located on the body 16*a* of the knob 16.

The display unit 4 graphically displays various information including the status of the major function select switch 2, the type of electric apparatus selected by the knob 16, what type of function is controlled by the knob 16 and how it has been controlled. It may be, for example, a liquid crystal display unit.

The controller 5 is electrically connected with the major function select switch 2, confirm switch 3, display unit 4, motor 14, encoder 20, stick controller 21, first solenoid 23, second solenoid 24, and an electric apparatus (not shown). It controls the display unit 4, motor 14, first solenoid 23, second solenoid 24 and electric apparatus (not shown) according to the signal sent from the major function select switch 2, confirm switch 3, encoder 20 or stick controller 21.

Figure 4:
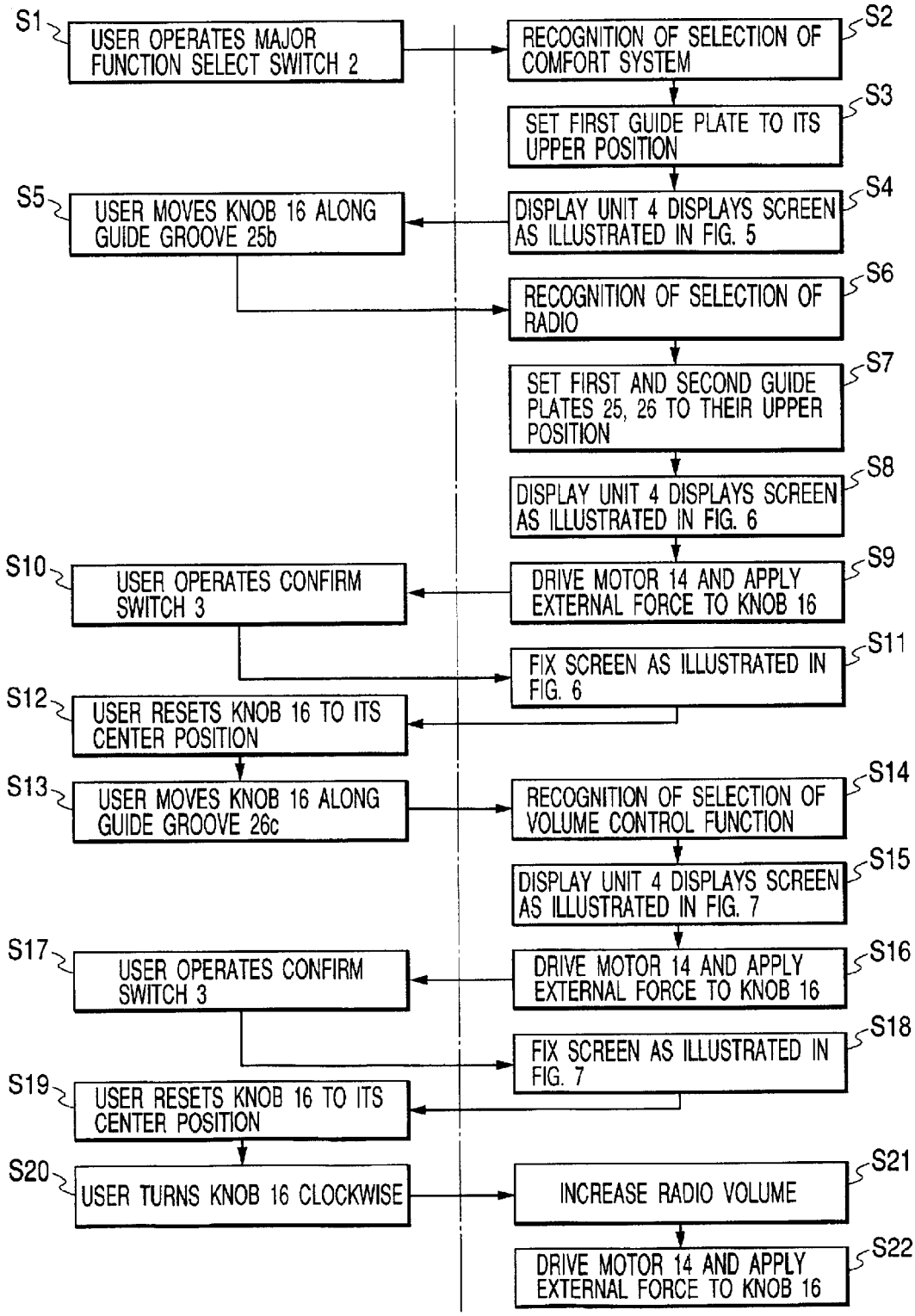
FIG. 4 is a flowchart showing the user operation sequence and the sequence of operations controlled by the controller for radio volume control.
Figure 5:
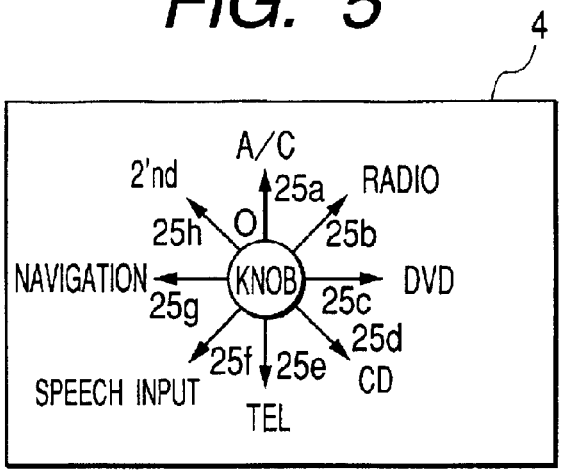
FIG. 5 shows an example of a screen which appears on the display unit when the major function select switch is operated.
Figure 6:
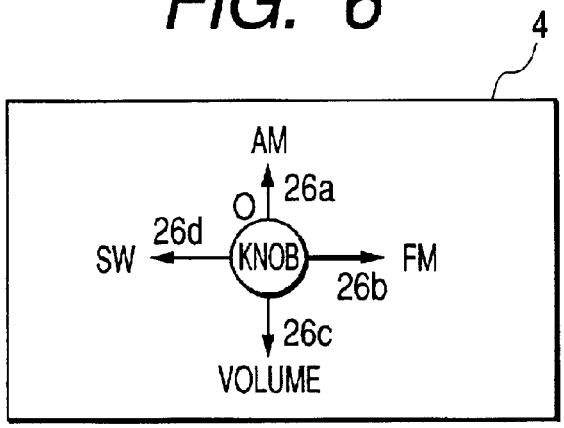
FIG. 6 shows an example of a screen which appears on the display unit when the radio is selected in electric apparatus selection.
Figure 7:
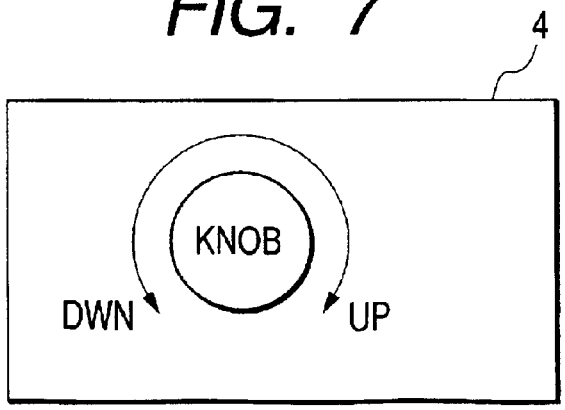
FIG. 7 shows an example of a screen which appears on the display unit when the volume control function is selected in functional selection.

Next, a first example of a manual input device structured as mentioned above will be explained by reference to FIGS. 4 to 7. This example concerns the procedure for controlling the radio volume using the manual input device. FIG. 4 is a flowchart illustrating the user operation sequence and the sequence of operations controlled by the controller; FIG. 5 shows an example of a screen which appears on the display unit when the major function select switch is operated; FIG. 6 shows an example of a screen which appears on the display unit when the radio is selected in electric apparatus selection; and FIG. 7 shows an example of a screen which appears on the display unit when the volume control function is selected in functional selection.

In this example, the user operates the switch 2*a* of the major function select switch 2 to select the "comfort system" among the three options: the "comfort system," "mechanical drive system" and "car drive system" (step S1).

The controller 5 picks up selection signal a3 from the major function select switch 2 and recognizes the selection of the "comfort system" (step S2), and drives the first solenoid 23 and/or the second solenoid 24 to set only the first guide plate 25 to its upper position (step S3). This limits the range of movement of the knob 16 to the eight directions from the center position 0 along the guide grooves 25*a* to 25*h* on the first guide plate 25.

The controller 5 drives the display unit 4 according to selection signal a3 to make the display unit 4 display a screen as illustrated in FIG. 5 which shows the various electric apparatuses in the "comfort system", the directions in which the knob 16 can be moved, and the electric apparatus selection mode (step S4). In the example of FIG. 5, the air conditioner (A/C) is selected by moving the knob 16 forward along the guide groove 25*a*; the radio is selected by moving it to the right forward along the guide groove 25*b*; the DVD player (DVD) is selected by moving it to the right along the guide groove 25*c*; the CD player is selected by moving it to the right backward along the guide groove 25*d*; the telephone (TEL) is selected by moving it backward along the guide groove 25*e*; the speech input system (speech input) is selected by moving it to the left backward along the guide groove 25*f*; the car navigation system is selected by moving it to the left along the guide groove 25*g*; and the secondary (2nd) is selected by moving it to the left forward along the guide groove 25*h*. In addition, the thick line in the figure shows that the air conditioner is now selected.

Then, as the user moves the knob 16 to the right forward along the guide groove 25*b* (step S5), the motor 14 laterally moves in the same direction as the knob 16 by the amount equivalent to the amount of manipulation of the knob 16 and the stick controller 21 issues positional signal a2 depending on the direction and amount of lateral movement of the motor 14.

The controller 5 picks up positional signal a2 and recognizes that the radio has been selected by the user (step S6), and drives the second solenoid 24 to set both the first guide plate 25 and second guide plate 26 to their upper position (step S7). This limits the range of movement of the knob 16 to the four directions from the center position O along the guide grooves 26*a* to 26*d* on the second guide plate 26.

The controller 5 drives the display unit 4 according to positional signal a2 to make the display unit 4 display a screen as illustrated in FIG. 6 which shows the various control function options for the "radio", the directions in which the knob 16 can be moved, and the option selected (step S8). In the example of FIG. 6, the AM station selection function (AM) is selected by moving the knob 16 forward along the guide groove 26*a*; the FM station selection function (FM) is selected by moving it to the right along the guide groove 26*b*; the volume control function is selected by moving it backward along the guide groove 26*c*; and the shortwave station selection function (SW) is selected by moving it to the left along the guide groove 26*d*. In addition, the thick line in the figure shows that the FM station selection function is now selected.

The controller 5 drives the motor 14 according to positional signal a2 and applies a particular external force to the knob 16 in the direction of movement of the knob 16 (step S9). This enables the user to know, with a tactile sensation or without seeing the screen, whether the radio has been selected.

Then, as the user operates the confirm switch 3 (step S10), the controller 5 picks up a final signal a4 from the confirm switch 3 and fixes the screen of the display unit 4 as illustrated in FIG. 6 (step S11).

After this, the user once resets the knob 16 to its center position O (step S12). In this case, since the motor 14 has a pressing member 15 for restoration to the center position, the user has only to release his/her hold on the knob to have it automatically return to the center position O.

If the knob 16 is reset to its center position O without any operation of the confirm switch 3, the controller 5 drives the second solenoid 24 to move down the second guide plate 26 to its lower position to return the screen of the display unit 4 to the screen as illustrated in FIG. 5, and waits for the user to manipulate the knob 16.

As the user moves the knob 16 from its center, position backward along the guide groove 26*c* (step S13) the motor 14 laterally moves in the same direction as the knob 16 by the amount equivalent to the amount of manipulation of the knob 16 and the stick controller 21 issues positional signal a2 depending on the direction and amount of lateral movement of the motor 14.

The controller 5 picks up this positional signal a2 and recognizes that the "volume control" function has been selected by the user (step S14), and the display unit 4 displays a screen as illustrated in FIG. 7 which shows the knob 16, the directions in which the knob 16 can be moved an how the volume has been controlled (step S15). In the example of FIG. 7, it is shown that the volume is increased (UP) and decreased (DWN) by turning the knob 16 clockwise and counterclockwise respectively.

The controller 5 drives the motor 14 according to positional signal a2 and applies a particular external force to the knob 16 in the direction of manipulation of the knob 16 (step S16). This enables the user to know, with a tactile sensation or without seeing the screen, whether the knob is being moved in the desired direction. Here, the external force which is applied to the knob 16 when it is moved backward along the guide groove 25*e* with only the first guide plate 25 in its upper position may be either equal or unequal to the external force which is applied to the knob 16 when it is moved backward along the guide groove 26*c* with both the first guide plate 25 and second guide plate 26 in their upper position.

Then, as the user operates the confirm switch 3 (step S17), the controller 5 picks up a final signal a4 from the confirm switch 3 and fixes the screen of the display unit 4 as illustrated in FIG. 7 (step S18).

After this, the user once resets the knob 16 to its center position O (step S19). In this case, since the motor 14 has a pressing member 15 for restoration to the center position, the user has only to release his/her hold on the knob 16 to make it automatically return to its center position O.

If the knob 16 is reset to its center position O without any operation of the confirm switch 3, the controller 5 returns the screen of the display unit 4 to the screen as illustrated in FIG. 6, and waits for the user to manipulate the knob 16.

As the user turns the knob 16 in its center position clockwise (step S20), the drive shaft 14*a* and the codewheel 18 fixed on the drive shaft 14*a* through the codewheel holder 17 turn in the same direction as the knob 16 by the amount equivalent to the amount of rotation of the knob 16 and the encoder 20 issues positional signal a1 depending on the direction and amount of rotation of the knob 16.

The controller 5 picks up this positional signal a1 to generate a volume control signal and increases the radio volume to a level which corresponds to positional signal a1 (step S21).

The controller 5 drives the motor 14 according to positional signal a1 and applies a particular external force to the knob 16 in the direction of manipulation of the knob 16 (step S22). This enables the user to know, with a tactile sensation or without seeing the screen, whether the knob 16 is being turned in the desired direction by the desired amount.

Figure 8:
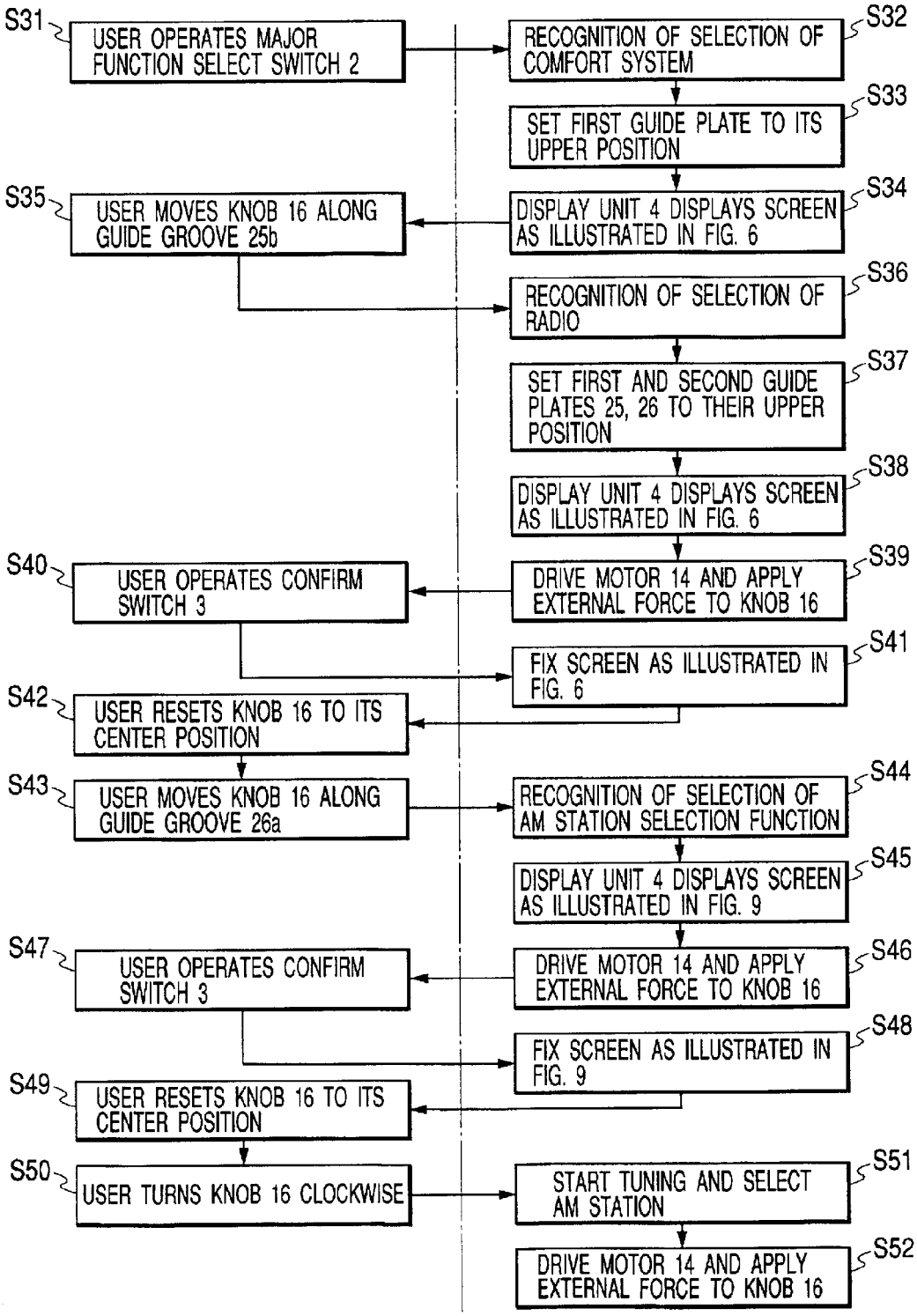
FIG. 8 is a flowchart showing the user operation sequence and the sequence of operations controlled by the controller for AM station selection.

Next, a second example of a manual input device structured as mentioned above will be explained by reference to FIGS. 8 to 9. This example concerns the procedure for selecting an AM radio station using the manual input device. FIG. 8 is a flowchart illustrating the user operation sequence and the sequence of operations controlled by the controller; and FIG. 9 shows an example of a screen which appears on the display unit when the AM station selection function is selected in functional selection.

In this example, steps S31 (the user operates the major function select switch 2) to S42 (the user resets the knob 16 to its center position) are identical to steps S1 to S12 in the first example given above.

After resetting the knob 16 to its center position O at step S42, when the user moves the knob 16 forward along the guide groove 26*a* (step S43), the motor 14 laterally moves in the same direction as the knob 16 by the amount equivalent to the amount of its manipulation and the stick controller 21 issues positional signal a2 depending on the direction and amount of lateral movement of the motor 14.

Figure 9:
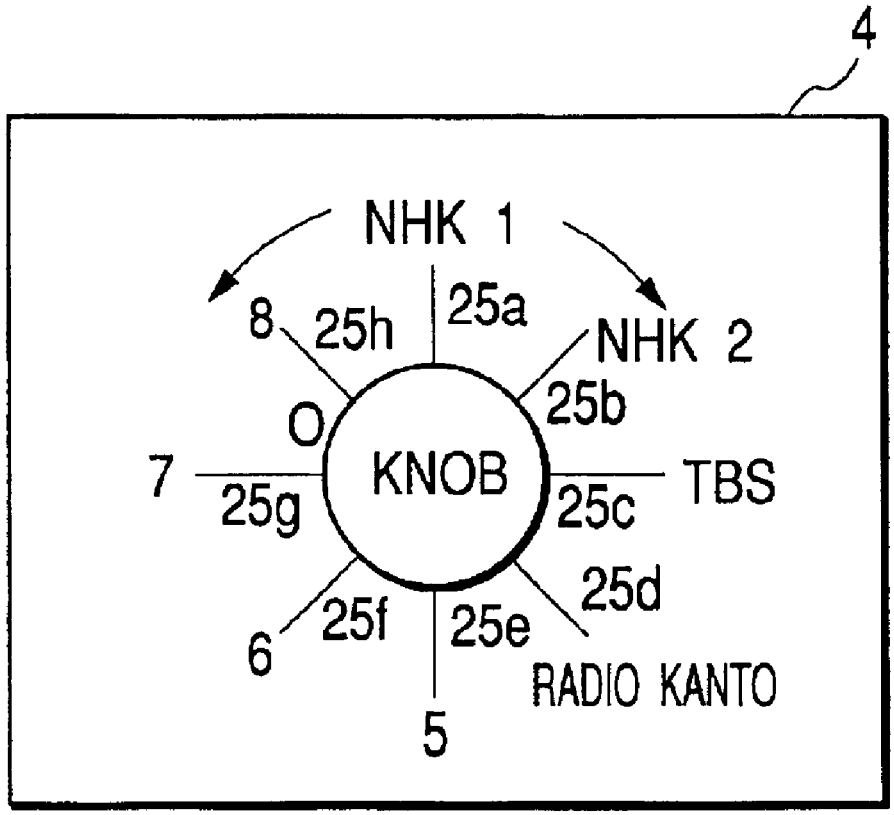
FIG. 9 shows an example of a screen which appears on the display unit when the AM station selection function is selected in functional selection.

The controller 5 picks up this positional signal a2 and recognizes that the user has selected the "AM station selection" function (step S44) and the display unit 4 displays a screen as illustrated in FIG. 9 which shows the knob 16, the directions which the knob 16 can be moved and which radio station is selected according to the direction of manipulation of the knob 16 (step S45). In the example of FIG. 9, the radio stations can be selected in the order from 1 to 8 and from 8 to 1 by turning the knob 16 clockwise and counterclockwise, respectively.

The controller 5 drives the motor 14 according to positional signal a2 and applies a particular external force to the knob 16 in the direction of manipulation of the knob 16 (step S46). This enables the user to know, with a tactile sensation or without seeing the screen, whether the knob 16 is being moved in the desired direction. Here, the external force which is applied to the knob 16 when it is moved forward along the guide groove 25*a* with only the first guide plate 25 in its upper position may be either equal or unequal to the external force which is applied to the knob 16 when it is moved forward along the guide groove 26*a* with both the first guide plate 25 and second guide plate 26 in their upper position.

Then, as the user operates the confirm switch 3 (step S47), the controller 5 picks up a final signal a4 from the confirm switch 3 and fixes the screen of the display unit 4 as illustrated in FIG. 9 (step S48).

After this, the user once resets the knob 16 to its center position O (step S49). In this case also, since the motor 14 has a pressing member 15 for restoration to the center position, the user has only to release his/her hold on the knob 16 to make it automatically return to its center position O.

If the knob 16 is reset to its center position O without any operation of the confirm switch 3, the controller 5 returns the screen of the display unit 4 to the screen as illustrated in FIG. 6, and waits for the user to manipulate the knob 16.

As the user turns the knob 16 in its center position clockwise (step S50), the drive shaft 14*a* and the codewheel 18 fixed on the drive shaft 14*a* through the codewheel holder 17 turn in the same direction as the knob 16 by the amount equivalent to the amount of rotation of the knob 16 and the encoder 20 issues positional signal a1 depending on the direction and amount of rotation of the knob 16.

The controller 5 picks up this positional signal a1 to generate a station selection control signal and starts tuning the radio (step S51).

Each time the tuner is tuned to a radio station, the controller 5 drives the motor 14 and applies an external force to the knob 16 (step S52). This enables the user to know, with a tactile sensation or without seeing the screen, that an AM station has been selected.

Next, a third example of a manual input device structured as mentioned above will be explained by reference to FIGS.

Figure 10:
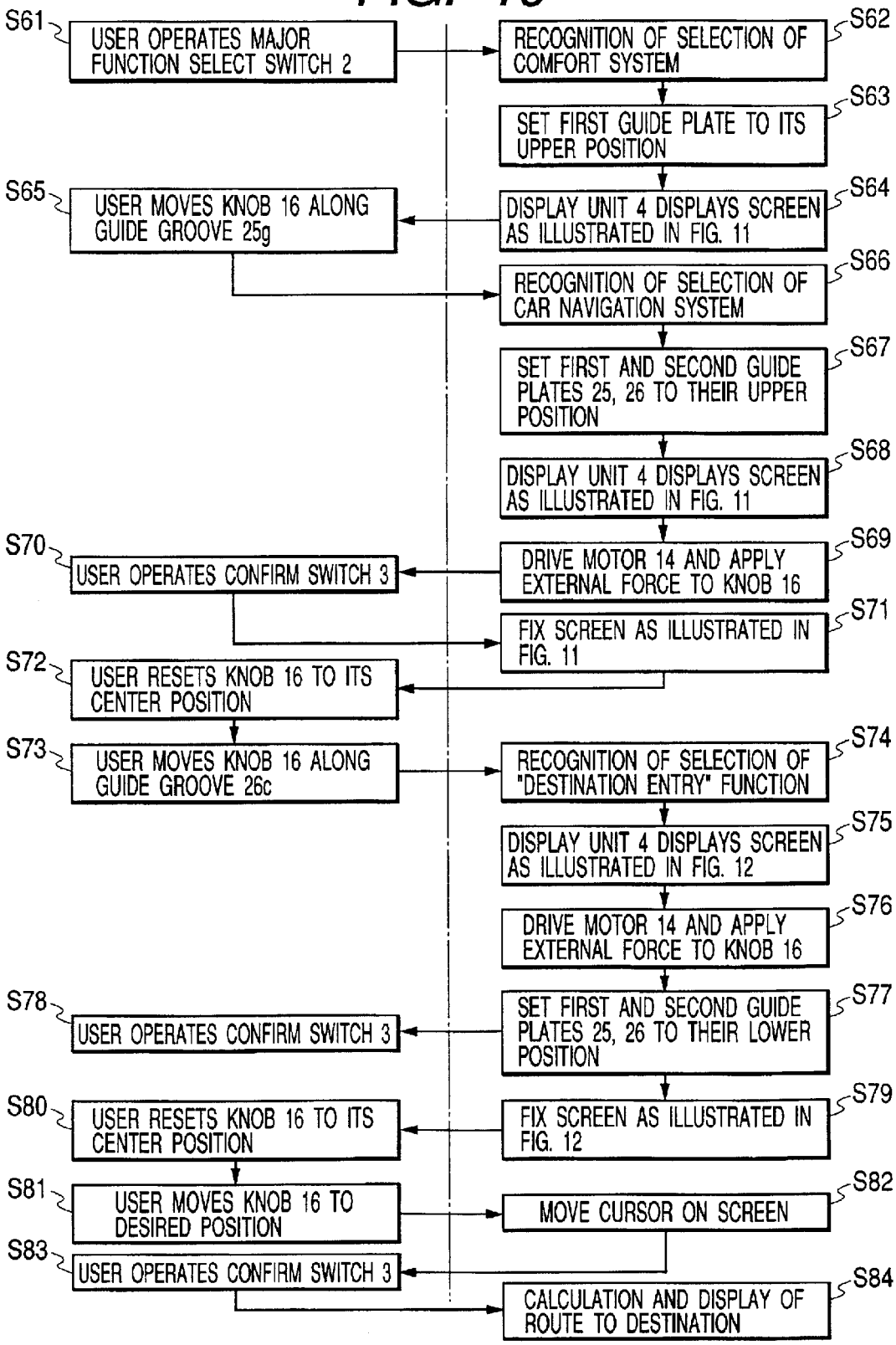
FIG. 10 is a flowchart showing the user operation sequence and the sequence of operations controlled by the controller for the car navigation system.
Figure 11:
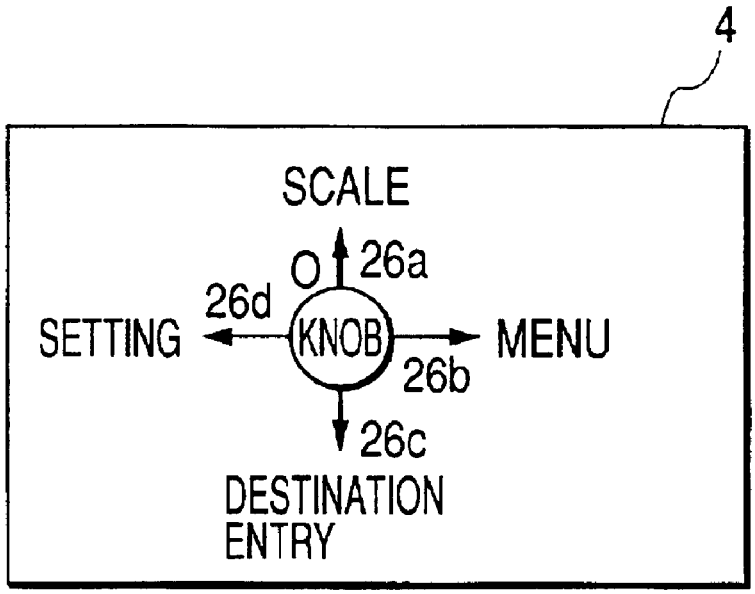
FIG. 11 shows an example of a screen which appears on the display unit when the car navigation system is selected in electric apparatus selection.
Figure 12:
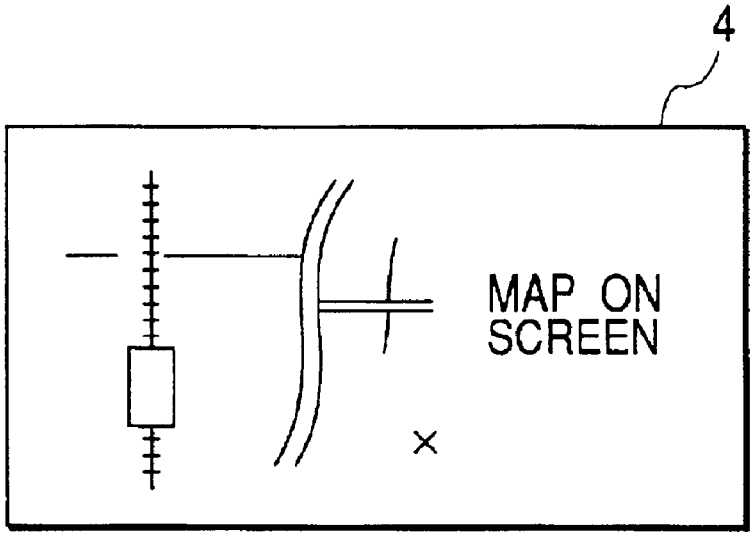
FIG. 12 shows an example of a screen which appears on the display unit when the destination entry function is selected in functional selection.
Figure 13:
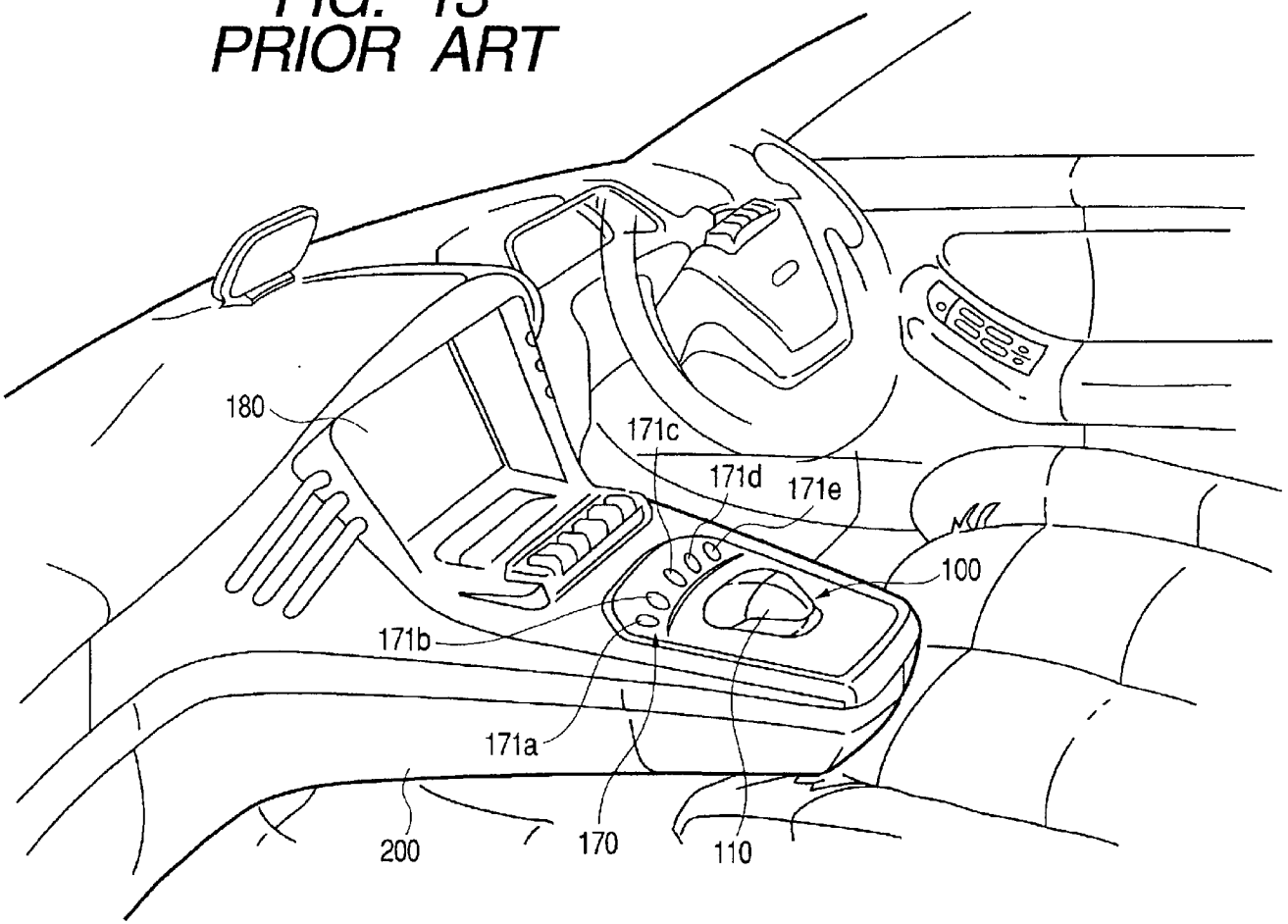
FIG. 13 PRIOR ART
FIG. 13 shows the inside of a car in which a conventional car-mounted input device is installed.
Figure 14:
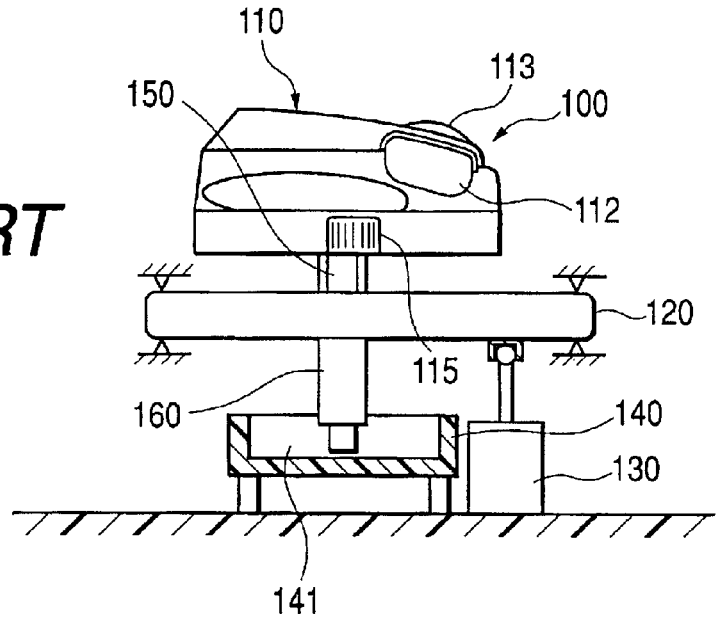
FIG. 14 PRIOR ART
FIG. 14 is a side view showing a conventional car-mounted input device as proposed.
Figure 15:
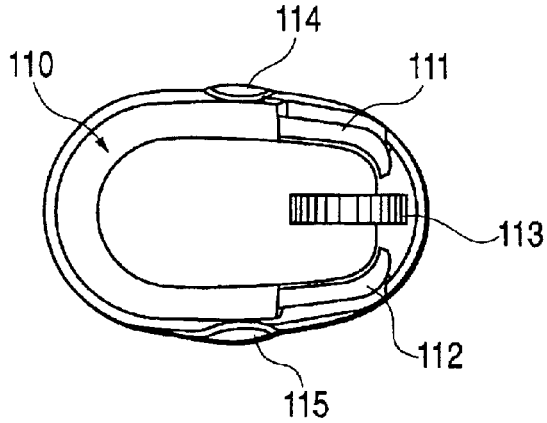
FIG. 15 PRIOR ART
FIG. 15 is a top view showing the car-mounted input device as shown in FIG. 14.
Figure 16:
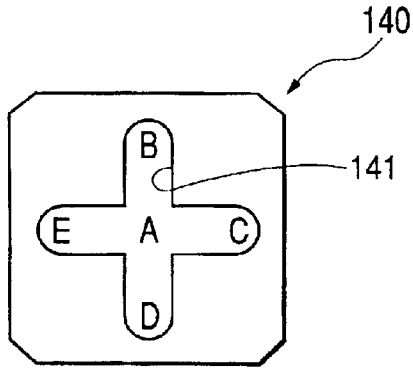
FIG. 16 PRIOR ART
FIG. 16 is a top view showing a guide plate built in the car-mounted input device as shown in FIG. 14.

10 to 12. This example concerns the procedure for setting a destination on a car navigation system using the manual input device. FIG. 10 is a flowchart showing the user operation sequence and the sequence of operations controlled by the controller; FIG. 11 shows an example of a screen which appears on the display unit when the car navigation system is selected in electric apparatus selection; and FIG. 12 shows an example of a screen which appears on the display unit when the destination entry function is selected in functional selection.

In this example, steps S61 (the user operates the major function select switch 2) to S64 (the display units displays a screen upon operation of the major function select switch) are identical to steps S1 to S4 in the first example given above.

When the user moves the knob 16 to the left along the guide groove 25*g* (step S65) while the display unit 4 displays a screen as illustrated in FIG. 5, the motor 14 laterally moves in the same direction as the knob 16 by the amount equivalent to the amount of its manipulation and the stick controller 21 issues positional signal a2 depending on the direction and amount of lateral movement of the motor 14.

The controller 5 picks up this positional signal a2, recognizes that the user has selected the "car navigation system" control function (step S66) and drives the second solenoid 24 to set both the first guide plate 25 and the second guide plate 26 to their upper position (step S67). This limits the range of movement of the knob 16 to the four directions from its center position O along the guide grooves 26*a* to 26*d* on the second guide plate 26.

The controller 5 drives the display unit 4 according to positional signal a2 to make the display unit 4 display a screen as illustrated in FIG. 11 which shows the various options for the "car navigation system", the directions in which the knob 16 can be moved, and the option selected (step S68). In the example of FIG. 11, the scale function is selected by moving the knob 16 forward along the guide groove 26*a*; the menu is selected by moving it to the right along the guide groove 26*b*; the destination entry function is selected by moving it backward along the guide groove 26*c*; and the setting function is selected by moving it to the left along the guide groove 26*d*. The thick line in the figure shows that the scale function is now selected.

The controller 5 drives the motor 14 according to positional signal a2 and applies a particular external force to the knob 16 in the direction of manipulation of the knob 16 (step S69). This enables the user to know, with a tactile sensation or without seeing the screen, whether the car navigation system has been selected.

Then, as the user operates the confirm switch 3 (step S70), the controller 5 picks up a final signal a4 from the confirm switch 3 and fixes the screen of the display unit 4 as illustrated in FIG. 11 (step S71).

After this, the user once resets the knob 16 to its center position O (step S72).

If the knob 16 is reset to its center position O without any operation of the confirm switch 3, the controller 5 drives the second solenoid 24 to move down the second guide plate 26 to its lower position, returns the screen of the display unit 4 to the screen as illustrated in FIG. 5, and waits for the user to manipulate the knob 16.

After resetting the knob 16 to its center position O at step S72, when the user moves the knob 16 backward along the guide groove 26*c* (step S73), the motor 14 laterally moves in the same direction as the knob 16 by the amount equivalent to the amount of its manipulation and the stick controller 21 issues positional signal a2 depending on the direction and amount of lateral movement of the motor 14.

The controller 5 picks up this positional signal a2 and recognizes that the user has selected the "destination entry" function (step S74) and the display unit 4 displays a screen as illustrated in FIG. 12 which shows a map and a cursor which follows the movement of the knob 16 (step S75). In the example of FIG. 12, the cursor is expressed by X.

The controller 5 drives the motor 14 according to positional signal a2 and applies a particular external force to the knob 16 in the direction of manipulation of the knob 16 (step S76). This enables the user to know, with a tactile sensation or without seeing the screen, whether the destination entry function has been selected by manipulation of the knob 16.

Further, the controller 5 drives the first solenoid 23 and the second solenoid 24 according to positional signal a2 to move down the first guide plate 25 and the second guide plate 26 to their lower position (step S77). This disengages the drive shaft 14*a* from the guide plates 25 and 26, so the knob 16 can be freely moved in any direction within the range of movement of the motor 14.

Then, as the user operates the confirm switch 3 (step S78), the controller 5 picks up a final signal a4 from the confirm switch 3 and fixes the screen of the display unit 4 as illustrated in FIG. 12 (step S79). After this, the user once resets the knob 16 to its center position O (step S80).

If the knob 16 is reset to its center position O without any operation of the confirm switch 3, the controller 5 returns the screen of the display unit 4 to the screen as illustrated in FIG. 11, and waits for the user to manipulate the knob 16.

As the user manipulates the knob 16 in its center position (step S81), the motor 14 laterally moves in the same direction as the knob 16 by the amount equivalent to the amount of its manipulation and the stick controller 21 issues positional signal a2 depending on the direction and amount of lateral movement of the motor 14.

The controller 5 picks up this positional signal a2 and moves the cursor on the screen of the display unit 4 (step S82). Thus, the user can move the cursor to any desired point on the map by manipulating the knob 16 while looking at the screen of the display unit 4.

After moving the cursor to the desired point on the map (step S82), the user operates the confirm switch 3 (step S83). The controller 5 picks up a final signal a4 from the confirm switch 3, calculates the route from the present position to the destination and displays it on the screen of the display unit 4 (step S84).

In the foregoing explanation of the preferred embodiments, descriptions have been made of only the procedures for controlling the radio volume, selecting an AM station and entering a destination on the car navigation system. However, it should be noted that the other various functions of any electric apparatus connected with the controller 5 can be controlled in the same manner as described above.

It is obviously possible to use three or more guide plates instead of the two guide plates used in the above embodiments.

Furthermore, it is also possible to use another type of actuators such as motors as actuators for driving the guide plates 25 and 26 instead of the solenoids 23 and 24 used in the above embodiments.

As explained so far, according to the present invention, the manual input device comprises a knob which can be moved in a desired direction, a plurality of guide plates which limit the directions in which the knob can be moved, actuators which change the engagement of the knob drive with the plural guide plates and a controller. Since the controller controls operation to change the engagement of the knob with the guide plates as appropriate, by disengaging the knob from the guide plates the knob can be moved in any direction and by engaging it with at least one guide plate, it can be moved only in the directions determined by a guide plate or a combination of guide plates engaged with it. Thus, it is possible to vary the combination of directions in which the knob can be moved. This means that when different selectable or controllable functions are assigned to different directions of movement of the knob, dead zones can be eliminated and the knob can be used for multiple purposes. Accordingly, a user-friendly manual input device is provided.

What is claimed is:

1. A manual input device comprising:

a knob which is movable in a desired direction and can be moved in a specific direction from a center position to select a specific function among functions of a plurality of electric apparatuses and control the selected function;

a plurality of guide plates which each limit directions in which the knob can be moved to a plurality of discrete directions;

actuators which change engagement of the knob with the plural guide plates; and a controller for the actuators, wherein the controller controls operation of the actuators depending on the electric apparatus function selected by manipulation of the knob and changes the engagement of the knob with the guide plates to selectively limit the directions in which the knob can be moved.

2. The manual input device according to claim 1, further comprising a first guide plate which limits movement of the knob to eight directions and a second guide plate which limits movement of the knob to four directions.

3. The manual input device according to claim 2, further comprising a first actuator which drives the first guide plate and a second actuator which drives the second guide plate.

4. The manual input device according to claim 3, wherein the first guide plate has eight guide grooves extending radially in eight directions every 45 degrees and wherein the second guide plate has four guide grooves extending in four directions every 90 degrees.

5. The manual input device according to claim 4, wherein four guide grooves among the eight guide grooves in the first guide plate coincide with the four guide grooves in the second guide plate when the first and second guide plates are joined.

6. The manual input device according to claim 5, further comprising a display unit which displays a screen matched to directions in which the knob can be moved.

7. The manual input device according to claim 1, further comprising a first actuator to apply an external force to the knob, wherein the controller controls operation of the first actuator to apply the external force to the knob depending on how the knob has been manipulated.

8. The manual input device according to claim 7, wherein the first actuator has a drive shaft, wherein the guide plates have guide grooves and wherein the actuator and the guide plates engage with each other when the drive shaft passes through the guide grooves.

9. The manual input device according to claim 8, wherein the guide plates are a first guide plate which limits movement of the knob to eight directions and a second guide plate which limits movement of the knob to four directions.

10. The manual input device according to claim 9, further comprising a second actuator which drives the first guide plate and a third actuator which drives the second guide plate.

11. The manual input device according to claim 10, wherein the first guide plate has eight guide grooves extending radially in eight directions every 45 degrees and wherein the second guide plate has four guide grooves extending in four directions every 90 degrees.

12. The manual input device according to claim 11, wherein four guide grooves among the eight guide grooves in the first guide plate coincide with the four guide grooves in the second guide plate when the first and second guide plates are both driven by the second and third actuators respectively and joined.

13. The manual input device according to claim 12, wherein when the first and second guid plates are driven and joined, the drive shaft of the first actuator passes through and engages with both the first and second guide plates.

14. The manual input device according to claim 13, a display unit which displays a screen matched to directions in which the knob can be moved.

* * * * *